US011326239B2

(12) United States Patent
Cao et al.

(10) Patent No.: US 11,326,239 B2
(45) Date of Patent: May 10, 2022

(54) IRON BASED ALLOY SUITABLE FOR PROVIDING A HARD AND CORROSION RESISTANT COATING ON A SUBSTRATE, ARTICLE HAVING A HARD AND CORROSION RESISTANT COATING, AND METHOD FOR ITS MANUFACTURE

(71) Applicant: Höganäs AB (Publ), Höganäs (SE)

(72) Inventors: Cecilia Cao, Hubei (CN); Chris Zhu, Beijing (CN); Bruc Zhang, Shanghai (CN); Crystal Liu, Shanghai (CN); Hans Hallén, Taiwan (CN)

(73) Assignee: HÖGANÄS GERMANY GMBH, Goslar (DE)

( * ) Notice: Subject to any disclaimer, the term of this patent is extended or adjusted under 35 U.S.C. 154(b) by 23 days.

(21) Appl. No.: 16/622,444

(22) PCT Filed: Jun. 21, 2017

(86) PCT No.: PCT/CN2017/089326
§ 371 (c)(1),
(2) Date: Dec. 13, 2019

(87) PCT Pub. No.: WO2018/232618
PCT Pub. Date: Dec. 27, 2018

(65) Prior Publication Data
US 2020/0109465 A1 Apr. 9, 2020

(51) Int. Cl.

| | |
|---|---|
| ***C22C 38/54*** | (2006.01) |
| ***C22C 33/02*** | (2006.01) |
| ***C22C 38/02*** | (2006.01) |
| ***C22C 38/04*** | (2006.01) |
| ***C22C 38/44*** | (2006.01) |
| ***C22C 38/50*** | (2006.01) |
| ***C23C 4/08*** | (2016.01) |
| ***C23C 24/10*** | (2006.01) |

(52) U.S. Cl.
CPC ..... *C22C 38/54* (2013.01); *C22C 33/0285* (2013.01); *C22C 38/02* (2013.01); *C22C 38/04* (2013.01); *C22C 38/44* (2013.01); *C22C 38/50* (2013.01); *C23C 4/08* (2013.01); *C23C 24/106* (2013.01)

(58) Field of Classification Search
CPC ... B22F 1/0003; C22C 33/0285; C22C 38/44; C22C 38/48; C22C 38/54; C22C 24/106; C22C 4/08
USPC ..... 420/64
See application file for complete search history.

(56) References Cited

U.S. PATENT DOCUMENTS

| | | | |
|---|---|---|---|
| 4,064,608 | A | 12/1977 | Jaeger |
| 2005/0072268 | A1 | 4/2005 | Sjodin et al. |
| 2015/0307968 | A1 | 10/2015 | Mars et al. |
| 2018/0104740 | A1 | 4/2018 | Yamamoto et al. |
| 2021/0147967 | A1* | 5/2021 | Cao ..... B32B 15/01 |

FOREIGN PATENT DOCUMENTS

| | | | |
|---|---|---|---|
| CN | 102619477 | A | 8/2012 |
| CN | 103695899 | A | 4/2014 |
| CN | 104846364 | A | 8/2015 |
| CN | 104988494 | A | 10/2015 |
| CN | 106480445 | A | 3/2017 |
| DE | 2744188 | A1 | 4/1978 |
| EP | 1525332 | A2 | 4/2005 |
| EP | 2664684 | A2 | 11/2013 |
| EP | 2722411 | A1 | 4/2014 |
| JP | S61119657 | A | 6/1986 |
| JP | S63-52703 | A | 3/1988 |
| JP | H11-222652 | A | 8/1999 |
| JP | 2004-522861 | A | 7/2004 |
| JP | 2016-509126 | A | 3/2016 |
| JP | 2016-194143 | A | 11/2016 |
| WO | 2004/003251 | A2 | 1/2004 |
| WO | 2008034614 | A1 | 3/2008 |

OTHER PUBLICATIONS

NPL: Machine translation of CN104988494 A, Oct. 2015 (Year: 2015).*

NPL: Machine translation of CN 104846364 A, Aug. 2015 (Year: 2015).*

International Search Report (PCT/ISA/210) dated Mar. 27, 2018, by the Chinese Patent Office as the International Searching Authority for International Application No. PCT/CN2017/089326.

Written Opinion (PCT/ISA/237) dated Mar. 27, 2018, by the Chinese Patent Office as the International Searching Authority for International Application No. PCT/CN2017/089326.

Office Action (Notification of the First Office Action) dated Mar. 14, 2021 by the State Intellectual Property Office of People's Republic of China in corresponding Chinese Patent Application No. 201780092337.1, and an English Translation of the Office Action. (13 pages).

(Continued)

*Primary Examiner* — Jie Yang

(74) *Attorney, Agent, or Firm* — Buchanan Ingersoll & Rooney P.C,

(57) ABSTRACT

An iron-based alloy that is able to provide a coating on a substrate, the coating having simultaneously high hardness, corrosion resistance and bonding strength to the substrate. The iron-based alloy has 16.00-20.00% by weight Cr; 0.20-2.00% by weight B; 0.20-4.00% by weight Ni; 0.10-0.35% by weight C; 0.10-4.00% by weight Mo; optionally 1.50% by weight or less Si; optionally 1.00% by weight or less Mn, optionally 3.90% by weight or less Nb; optionally 3.90% by weight or less V; optionally 3.90% by weight or less W; and optionally 3.90% by weight or less Ti; the balance being Fe and unavoidable impurities; with the proviso that the total amount of Mo, Nb, V, W and Ti is in the range of 0.1-4.0% by weight of the alloy.

20 Claims, No Drawings

(56) References Cited

OTHER PUBLICATIONS

Office Action (Notice of Reasons for Refusal) dated May 31, 2021, by the Japanese Patent Office in corresponding Japanese Patent Application No. 2019-570903, and an English Translation of the Office Action. (10 pages).

Office Action (Communication pursuant to Article 94(3) EPC) dated Jun. 21, 2021, by the European Patent Office in corresponding European Application No. 17 915 016.4-1103, (8 pages).

Office Action dated Jul. 29, 2021, by the Federal Public Service Ministry of Economy National Institute of Industrial Property in Brazilian Patent Application No. BR112019026431-0 and an English Translation of the Office Action. (5 pages).

Office Action (the Second Office Action) dated Aug. 30, 2021, by the State Intellectual Property Office of the People's Republic of China in corresponding Chinese Patent Application No. 201780092337.1, and an English Translation of the Office Action. (16 pages).

Office Action (Notification of Reason for Refusal) dated Oct. 15, 2021, by the Intellectual Property Office in corresponding Korean Patent Application No. 10-2020-7001917, and an English Translation of the Office Action. (16 pages).

* cited by examiner

IRON BASED ALLOY SUITABLE FOR PROVIDING A HARD AND CORROSION RESISTANT COATING ON A SUBSTRATE, ARTICLE HAVING A HARD AND CORROSION RESISTANT COATING, AND METHOD FOR ITS MANUFACTURE

FIELD OF THE INVENTION

The present invention generally belongs to the field of iron-based alloys, in particular those having hardness and corrosion resistance. The present invention furthermore belongs to the field of articles having a hard and corrosion resistant coating made from an iron based alloy, and to methods for the manufacture of such articles using the iron-based alloy of the present invention.

BACKGROUND OF THE INVENTION

Iron-based alloys such as various types of steel are used in a multitude of applications, but sometimes lack as such the required properties. As one example, a steel material may not be sufficiently hard and corrosion resistant to withstand harsh conditions during use, as observed in e.g. drilling and mining machines.

To this end, hard chromium plating has been used to provide protective coatings on machinery that is exposed to harsh conditions and wear, such as in mining & steel applications or tunnel drilling machines. Such chromium coatings have been commonly used for obtaining coatings having bright appearance, high wear and corrosion resistance. Aerospace, oil&gas and heavy industrial equipment, such as mining equipment, are the major end industries for these coatings.

A hard chromium coating is typically formed on a conductive, typically metallic, substrate by electrodeposition of chromium from aqueous solution containing chromium ions. The application of hard chromium coating has however decreased due to stricter environmental legislations regarding hexavalent chromium, $Cr^{VI}$ used in the process or being contained in waste resulting therefrom.

Due to its formation by electrodeposition, in this way hard chromium platings can only be provided on electrically conductive substrate surfaces. Further, the manufacture of a coating by electrodeposition can be energy intensive, and can further lead to problems in cases where complex structures are to be formed. Further, electrodeposition processes are generally only able to provide a coating layer of uniform thickness on all parts of the substrate emerged into an electrolytic coating, and are thus unable to provide a coating in varying thicknesses and/or only on selected parts of a substrate.

A further disadvantage of chromium coatings (or platings) in general is the relatively low bond strength between the coating and the support material. Without wishing to be bound by theory, it is believed that in particular in cases where the support material is based on iron (i.e. is iron or is an iron-based alloy such as steel), there is insufficient compatibility between the crystal structure or the iron-based material and the chromium, so that a sharp transition between the iron-based material and the chromium coating is present. It is thus believed that there is no metallurgical bonding between the chromium layer and the surface of the iron-based material. Herein, a "metallurgical bonding" denotes the presence of an intermediate metallurgical phase forming a transition between the substrate, on the one side, and the coating layer, on the other side. Such an intermediate metallurgical phase generally has a composition that differs from both the composition of the substrate and the composition of the coating, and may also have crystal structure that is different from both the crystal structure of the substrate and the crystal structure.

In view of these problems and limitations, the search for a replacement of hard chrome plating started almost 30 years ago. Thermal spray methods such as HVOF (High Velocity Oxy-fuel coating spraying), have replaced several hard chrome plating applications, for examples for aircraft landing gear and hydraulic cylinders.

The main requirements for coatings that shall replace hard chrome plating include good corrosion, wear resistance and improved bond strength. The latter should be a metallurgical bonding between substrate material and coating, which is best achieved with a minimal heat input in order to avoid deterioration of the substrate and/or the coating.

Laser cladding is a well-established process that may generally be set up to meet these requirements. Laser cladding might thus be an alternative to hard chrome plating for many applications, as it could allow applying thin corrosion and wear resistant deposits with minimal impact on the substrate material. Due to the high temperature in the laser impact region on the substrate, laser cladding is also better suited to achieve a metallurgical bonding as compared to electrodeposition. The ability to provide a metallurgical bonding was also found to distinguish laser cladding from both hard chrome plating and HVOF.

In a laser cladding process, martensitic stainless steel, like SUS 431, has frequently been used as coating material. The materials used previously were however unable to simultaneously reach high hardness and good corrosion resistance. The alloys currently in use may either exhibit a hardness of less than 53 HRC while exhibiting corrosion resistance, or may show a hardness of higher than 53 HRC, yet then exhibit insufficient corrosion resistance.

In certain cases both criteria of exhibiting high hardness and sufficient corrosion resistance have been achieved, but in such cases unstable coating properties were obtained that do not fulfill quality demands, e.g. as regards adhesion to the substrate.

In addition to being able to achieve high hardness and good corrosion resistance, the powder used for a laser cladding process should also have good weldability, and the deposit should only exhibit minor variations of the chemistry, e.g. by even dilution of the substrate.

Problems to be Solved by the Invention

The present invention aims at providing a material able to form a protective coating having simultaneously high hardness, sufficient corrosion resistance and sufficient adhesion to the substrate on which the coating is provided. The coating material should also be available at reasonable costs and should be employable using existing processes such as laser cladding, HVOF, HVAF, plasma spraying or plasma transfer arc treatment.

Further problems to be solved by the present invention will also become apparent in view of the following description.

SUMMARY OF THE INVENTION

The present invention has solved the above problems by providing the following:

1. An iron-based alloy, consisting of
   16.00-20.00% by weight Cr;
   0.20-2.00% by weight B;
   0.20-4.00% by weight Ni;
   0.10-0.35% by weight C;
   0.10-4.00% by weight Mo;
   optionally 1.50% by weight or less Si;
   optionally 1.00% by weight or less Mn,
   optionally 3.90% by weight or less Nb;
   optionally 3.90% by weight or less V;
   optionally 3.90% by weight or less W; and
   optionally 3.90% by weight or less Ti;
   the balance being Fe and unavoidable impurities;
   provided that the total of Mo, Nb, V, W and Ti is in the range of 0.1-4.0% by weight of the alloy.
2. The iron-based alloy according to aspect 1, wherein the content of Cr is from 16.50-19.50% by weight.
3. The iron-based alloy according to aspect 1 or aspect 2, wherein the content of B is from 0.20-1.20% by weight.
4. The iron-based alloy according to any one of aspects 1 to 3, wherein the content of Ni is from 0.20-3.00% by weight.
5. The iron-based alloy according to any one of aspects 1 to 4, wherein the content of Nb is from 0.20-3.00% by weight.
6. The iron-based alloy according to any one of aspects 1 to 5, wherein the content of the optional components Nb, V, W and Ti is each 1.50% by weight or less.
7. The iron-based alloy according to any one of aspects 1-6, which is in powder form.
8. The iron-based alloy according to aspect 7, wherein the powder contains no or less than 2% by weight of particles having a particle size exceeding 250 μm as measured by sieve analysis according to ASTM B214-16.
9. The iron-based alloy in powder form according to any one of aspects 7 and 8, which consists of particles having a particle size between 5-200 μm or 20-200 μm as measured by sieve analysis according to ASTM B214-16.
10. An article having a substrate and a coating, the coating being formed from an iron-based alloy as defined in any one of aspects 1 to 9.
11. Article according to aspect 10, which is a hydraulic cylinder or roller used in the mining or steel industry.
12. The article according to aspect 10 or 11, wherein the coating has one or both of
    a hardness of 53 HRC or greater as measured by SS-EN ISO 6508-1:2016; and
    a corrosion resistance of 5000 hours (30 weeks) or more in a neutral salt spray test (5% NaCl) at 35° C. according to ISO 9227:2017.
13. The article according to any one of aspect 10 to 12, wherein the coating is metallurgically bond to the substrate.
14. The article according to any one of aspects 10 to 13, wherein the substrate is made of a metal or metal alloy, preferably steel, tool steel, or stainless steel.
15. The article according to any one of aspects 10 to 14, wherein the coating is formed by laser cladding, plasma spraying, HVOF, HVAF, cold spraying or plasma transfer arc of the iron-based alloy, the iron-based alloy powder being as defined in any one of aspects 7 to 9.
16. Use of the iron-based alloy according to any one of aspects 1 to 6 or the iron-based alloy powder according to any one of aspects 7 to 9 for forming a coating on a substrate.
17. A method for forming an coated article, comprising the steps of
    providing a substrate and
    forming a coating on the substrate
    wherein the coating is made of an alloy as defined in any one of aspects 1 to 6 and the step of forming the coating utilizes an alloy powder as defined in aspects 7 to 9.
18. The method for forming a coated article according to aspect 18, wherein the step of forming a coating is a laser cladding step, a plasma spraying step, a plasma transfer arc step HVAF, cold spraying or a HVOF step.
19. The method for forming a coated article according to aspect 17 or 18, wherein the article is defined as in any one of aspects 10 to 15.

DETAILED DESCRIPTION OF THE INVENTION

In the present invention, all parameters and product properties relate to those measured under standard conditions (25° C., $10^5$ Pa) unless stated otherwise.

The term "comprising" is used in an open-ended manner and allows for the presence of additional components or steps. It however also includes the more restrictive meanings "consisting essentially of" and "consisting of".

Whenever a range is expressed as "from x to y", or the synonymous expression "x-y", the end points of the range (i.e. the value x and the value y) are included. The range is thus synonymous with the expression "x or higher, but y or lower".

The invention relates to an iron-based alloy as defined above and recited in claim 1. Herein, the term "iron-based" denotes that iron has the largest content (in weight-% of the total alloy) among all alloying elements. The content of iron will exceed 65% by weight, and will typically also exceed 70% by weight of the total weight of the alloy.

The alloy of the present invention consists of 16.00-20.00% by weight Cr; 0.20-2.00% by weight B; 0.20-4.00% by weight Ni; 0.10-0.35% by weight C; 0.10-4.00% by weight Mo; optionally 1.50% by weight or less Si; optionally 1.00% by weight or less Mn, optionally 3.90% by weight or less Nb; optionally 3.90% by weight or less V; optionally 3.90% by weight or less W; and optionally 3.90% by weight or less Ti; the balance being Fe and unavoidable impurities; provided that the total of Mo, Nb, V, W and Ti is in the range of 0.1-4.0% by weight of the alloy.

Herein, the "unavoidable impurities" denote those components that originate from the manufacturing process of the alloy of which are contained as impurities in the starting materials. The amount of unavoidable impurities is generally 0.10% by weight or less, preferably 0.05% by weight or less, further preferably 0.02% by weight or less, most preferably 0.01% by weight or less. Typical impurities include P, S, and other impurities well known to a skilled person. Notably, while some of the elements recited in claim 1 may be regarded as impurities in other alloys, in the alloy of the present invention the elements recited above and in the claims are not encompassed by the term "unavoidable impurities", as they are intentionally added to the alloy of the present invention.

The alloy of the present invention can be manufactured by conventional methods well known to a person skilled in the art. For instance, it is possible to prepare the alloy of the present invention by mixing together powders of the metal elements in a suitable proportion and melting the mixture, followed by appropriate cooling.

The composition recited in claim 1 relates to the content of the respective alloying elements in weight %, as determined by Atomic Absorption Spectroscopy (AAS). Notably, the alloy composition as present in the final coating, as present on a substrate after using a suitable process such as laser cladding for forming a coating of the alloy of the invention, may differ slightly from the alloy composition defined in claim 1, which is the composition of the raw material powder employed during the coating formation step, e.g. in the laser cladding step or plasma spraying originating from the environment (e.g. nitrogen or oxygen by laser cladding in air, or carbon or oxygen or nitrogen by plasma cladding using a hydrocarbon gas as fuel) may be incorporated to some extent into the coating. Further the composition of the coating will differ to the powder due to the dilution of the base material.

The elements of the alloy will now be described with reference to their believed function and preferred amounts:

Chromium (Cr)

Chromium (Cr) is present in an amount of 16.00-20.00% by weight of the alloy. Chromium serves to render the obtained coating to be sufficiently hard and corrosion-resistant. The lower limit of the amount of Cr is 16.00% by weight, but the amount of Cr can also be higher than 16.00% by weight, such as 16.50% by weight or higher or 17.00% by weight or higher. The higher limit is 20.00% by weight, by can also be less than 20.00% by weight, such as 19.50% by weight or 19.00% by weight. These upper and lower limits can be combined freely, so that the amount of Cr may be in the range of 16.50-19.50% by weight or 16.00-19.00% by weight.

It is believed that an amount of Cr exceeding 12% in solid solution gives sufficient corrosion resistance. Without wishing to be bound by theory, it is assumed that alloying with elements like C and B will decrease the solid solution concentration of Cr by forming carbides and borides, so that the amount of Cr is set higher than 12% by weight, i.e. to be sufficiently higher to compensate for the loss by carbide and boride formation.

On the other hand, the content of Cr should not be too high high in solid solution as the amount of delta-ferrite will increase and thus decrease the hardness of the deposit. It has been found that within the above ranges for the Cr content, optimum results with regard to hardness and corrosion resistance could be realized.

Boron (B)

Boron is present in an amount of 0.20-2.00% by weight. The lower limit is 0.20% by weight, but can also be higher than 0.20% by weight, such as 0.25 or 0.30% by weight. The upper limit is 2.00% by weight, but can also be less than 2.00% by weight, such as 1.80% by weight or less, or 1.50% by weight or less. Preferably, the upper limit of the amount of B is 1.20% by weight or less.

The presence of B decreases the liquidus temperature, typical by about 100° C., as compared to similar alloys without B. The lower melting point decreases the energy consumption for melting the alloy powder used in a coating process at its surface, and thus also decreases the HAZ (heat affected zone), which benefits product quality and allows substantially avoiding deterioration of the substrate and the alloy. B also increases the weldabilty of the alloy.

As a consequence, by including boron within the specified amount, the obtained coating process becomes more robust with less variations of the chemical composition in the deposited coating, and the coating can be provided in an energy-efficient manner. Further, the borides formed during the solidification are an essential part of the invention to maintain the hardness of the coating.

Nickel (Ni)

Nickel mainly serves to improve the corrosion resistance, and it is present in an amount of 0.20-4.00% by weight. The lower limit of the amount of Ni is 0.20% by weight, but can also be 0.30% by weight, 0.40% by weight or 0.50% by weight. Preferably, the lower limit of the amount of Ni is 0.75% by weight or more, further preferably 1.00% by weight or more.

The upper limit of the amount of Ni is 4.00% by weight or more, but can also be 3.50% by weight. Preferably, the amount of Ni is 3.00% by weight or less, but can also be 2.80% by weight or less.

Carbon (C)

Carbon is added to give the right hardness of the martensite and to form hard particles, thereby increasing the hardness of the coating obtained from the alloy of the present invention.

The amount of carbon is 0.10-0.35% by weight. The lower limit is 0.10% by weight, but can also be 0.12% by weight or higher, or 0.14% by weight or higher.

Without wishing to be bound by theory, it is believed that the reason for the lower limit being 0.10% by weight is that with such an amount of carbon, the martensite is increasing the hardness. The upper limit of the carbon content is 0.35% by weight, but can also be 0.30% by weight or lower, and preferably is 0.25% by weight or lower or 0.20% by weight or lower.

Molybdenum (Mo)

Without wishing to be bound by theory, the alloying of Mo is believed to enhance the pitting corrosion resistance, the so-called PRE value.

In the alloy of the present invention, Mo is contained in an amount of 0.10-4.00% by weight. The lower limit is 0.10% by weight or more, but can also be 0.15% by weight or more, and is preferably 0.20% by weight or more.

The upper limit is 4.00% by weight or less, but can also be 3.50% by weight or less, and is preferably 3.00% by weight or less, further preferably 2.50% by weight or less or 2.00% by weight or less.

Optional Components

The alloy may also contain one or more of the following optional components:

1. 1.50% by weight or less Si;
2. 1.00% by weight or less Mn,
3. 3.90% by weight or less Nb;
4. 3.90% by weight or less V;
5. 3.90% by weight or less W; and
6. 3.90% by weight or less Ti;

These components may be completely absent, but the present invention also encompasses embodiments wherein one, two, three, four, five or all six of them are present. For instance, Si and Mn may be present, while Nb, V, W and Ti are absent. As another Example, Si, Mn and Nb may be present, while V, W and Ti are absent. A further example is an alloy wherein Mn, Nb and Ti are present, while Si, V and W are absent.

Without wishing to be bound by theory, it is believed that alloying with one, two, three or all four selected from the group consisting of Nb, V, W and Ti will form hard particles and increase the hardness of the coating while keeping a higher Cr in solid solution. This is believed to improve the corrosion resistance of the final coating.

1. Silicon (Si)

If silicon is present, its amount is 1.50% by weight or less, preferably 1.25% by weight or less, more preferably 1.00% by weight or less.

As Si is optional, there is no specified lower limit. Yet, if Si is present, its amount can be 0.01% by weight or more, or 0.05% by weight or more, such as 0.10% by weight or more.

Si is mainly added in order to avoid the formation of oxides of Fe and other alloying metals, as Si has a high affinity to oxygen. Adding Si is thus preferred in cases where the starting materials of the alloy contain oxygen or oxides, or where the manufacture of the alloy is conducted under oxygen-containing conditions.

2. Manganese (Mn)

If Mn is present, its amount is 1.00% by weight or less, preferably 0.80% by weight or less, more preferably 0.60% by weight or less, such as 0.50% by weight or less.

As Mn is optional, there is no specified lower limit. Yet, if Mn is present, its amount can be 0.01% by weight or more, or 0.05% by weight or more, such as 0.10% by weight or more.

3. Niobium (Nb)

If Nb is present, its amount is 3.90% by weight or less, such as 3.00% by weight or less. Its amount can also be 2.50% by weight or less, and in one embodiment is 2.00% by weight or less. Preferably, the amount of Nb (if present) is 1.5% by weight or less.

As Nb is optional, there is no specified lower limit. Yet, if Nb is present, its amount can be 0.01% by weight or more, or 0.05% by weight or more, such as 0.10% by weight or more.

4. Vanadium (V)

If V is present, its amount is 3.90% by weight or less, such as 3.00% by weight or less. Its amount can also be 2.50% by weight or less, and in one embodiment is 2.00% by weight or less. Preferably, the amount of V (if present) is 1.5% by weight or less.

As V is optional, there is no specified lower limit. Yet, if V is present, its amount can be 0.01% by weight or more, or 0.05% by weight or more, such as 0.10% by weight or more.

5. Tungsten (W)

If W is present, its amount is 3.90% by weight or less, such as 3.00% by weight or less. Its amount can also be 2.50% by weight or less, and in one embodiment is 2.00% by weight or less. Preferably, the amount of W (if present) is 1.5% by weight or less.

As W is optional, there is no specified lower limit. Yet, if W is present, its amount can be 0.01% by weight or more, or 0.05% by weight or more, such as 0.10% by weight or more.

6. Titanium (Ti)

If Ti is present, its amount is 3.90% by weight or less, such as 3.00% by weight or less. Its amount can also be 2.50% by weight or less, and in one embodiment is 2.00% by weight or less. Preferably, the amount of Ti (if present) is 1.5% by weight or less.

As Ti is optional, there is no specified lower limit. Yet, if Ti is present, its amount can be 0.01% by weight or more, or 0.05% by weight or more, such as 0.10% by weight or more.

Restriction of the Amount of Mo, Nb, V, W and Ti

In the alloy of the present invention, the total amount of Mo, Nb, V, W and Ti is in the range of 0.10-4.00% by weight of the alloy. Of course, an element that is absent does not contribute to this amount.

Again without wishing to be bound by theory, it is considered that the reason for this limitation of the amount of these optional components is that a higher total amount would lead to a distortion of the crystal structure of the alloy and the final coating, which in turn reduce toughness and strength, and may also reduce the corrosion resistance. Yet, at least 0.10% by weight of the total of Mo, Nb, V, W and Ti is required in order to obtain hard particles and to thereby increase the hardness of the coating. The elements present will also keep a higher Cr in solid solution, which is believed to improve the corrosion resistance of the final coating.

Put differently, Mo can be present in an amount of up to 4.00% by weight, and is required to be present in an amount of 0.10% by weight or more. A part of the Mo in excess of 0.10% by weight can be replaced by one, two, three or four of Nb, V, W and Ti.

The total amount of Mo, Nb, V, W and Ti is in the range of 0.10-4.00% by weight of the alloy. If the optional components Nb, V, W and Ti are absent, this amount is solely formed by Mo. The lower limit of the total amount of Mo, Nb, V, W and Ti is 0.10% by weight or higher, but can also be 0.50% by weight or higher or 1.00% by weight or higher.

The upper limit of the total amount of Mo, Nb, V, W and Ti is the same as recited above for Mo alone, and is thus 4.0% by weight or less, and is preferably 3.00% by weight or less, further preferably 2.50% by weight or less or 2.00% by weight or less.

Powder and Powder Manufacture

During its use for forming a coating by a method such as laser cladding or plasma transferred arc cladding, the alloy may be required to be in powder form.

The method for producing the powder is not particular limited, and suitable methods are well known to a person skilled in the art. Such methods include atomization, e.g. by using water or gas atomization.

The powder particles originating from the powder production can be used as such, but may be classified by suitable operations such as sieving in order to eliminate too large or too small particles, e.g. in order to reduce their amount to 2% by weight or less, or to eliminate them completely.

The particles are preferably sieved in order to reduce the content of particles exceeding 250 μm in particle size and particles smaller than 5 μm. The absence or presence of such particles can then be determined by sieve analysis, following e.g. ASTM B214-16.

Alternatively, a skilled person may also employ other means for determining the particle size distribution, using e.g. a laser scattering technique as defined in ISO 13320: 2009 and employed for instance by the Mastersizer™ 3000, obtainable from Malvern. Herein, the average diameter Dw90 is preferably from 5 to 250 μm, more preferably from 10 to 100 μm, further preferably from 10 to 80 μm. In case there should be a discrepancy between a particle size obtained by sieve analysis and a particle size obtained by laser scattering, the laser scattering technique is to be used and prevails.

Corrosion Resistance and Hardness

The coating obtained from the alloy of the present invention shows simultaneously corrosion resistance and hardness, unlike coatings obtained from prior art alloys, while at the same time also allowing to obtain high bonding strength to the substrate.

In the present invention, corrosion resistance can be determined by a salt water spray test employing a 5 weight-% aqueous neutral solution of sodium chloride at 35°

C., following ISO 9227:2017. The coating has preferably a corrosion resistance of 5000 hours or more, more preferably 8000 hours or more, further preferably 10000 hours or more.

Hardness refers to HRC (Rockwell Hardness) determined according to SS ISO 6508-1:2016. The coating has preferably a hardness of 53 HRC or higher, more preferably 56 HRC or higher.

Substrate and Substrate Bonding

The substrate on which the coating of the present invention is to be provided is not particularly limited, but is in any case a heat resistant inorganic material in order to allow for a deposition process utilizing elevated temperatures of e.g. 250° C. or higher on the substrate surface. The substrate is typically selected from ceramic materials, cermet materials and metallic materials. The metallic material is preferred, and is preferably selected from a metal or a metal alloy. The metal alloy is preferably iron-based, and a particular preferred example includes steel, including stainless steel and tool steel.

In one embodiment, the substrate is made from a metallic material having a lower melting point as the alloy of the invention. This is believed to facilitate the formation of a metallurgical bonding between the coating made from the alloy of the invention and the substrate, as then the powder particles of the alloy hitting the substrate will partially melt the substrate, allowing for a better diffusion of the alloy of the present invention into the substrate and possibly allowing for the formation of a certain metallurgical transition phase between the substrate and the coating.

The presence of a metallurgical bonding between the substrate can be evaluated by examining the transition area between the coating and the substrate in a cross-section of the coated article. Such an observation can be made by a suitable microscope. A metallurgical bond present in the transition area between the substrate and the coating preferably gives rise to an X-ray diffraction pattern that is different from the pure substrate and the pure alloy and/or the coating, thereby indicating the formation of a transition phase.

Coating Process

The coated article can be formed by providing a coating of the alloy on the article, and the method for producing is not particularly limited. Preferred methods include a coating forming step employing any one of laser cladding, plasma spraying, or plasma transfer arc (PTA). Yet, in principle any thermal spraying process can be employed, including HVOF or HVAF or cold spraying.

EXAMPLE

The inventors prepared an example of a powdered alloy having a size distribution of 45-180 μm and the following composition (in weight-%):

| Fe | C | Cr | B | Mo | Ni | Mn | Si |
|---|---|---|---|---|---|---|---|
| Bal | 0.17 | 18.10 | 0.85 | 0.33 | 2.80 | 0.40 | 0.80 |

The powder alloy was laser cladded on a steel cylinder, 200 mm diameter and 500 mm long, with a dilution of 7% using a Laserline fibre laser with a power 7.5 kW.

The coating showed a hardness of 56 HRC. The cylinder was placed in a salt spray chamber for 5,000 h and no corrosion was found.

The invention claimed is:

1. An iron-based alloy, consisting of
16.00-20.00% by weight Cr;
0.20-2.00% by weight B;
0.20-4.00% by weight Ni;
0.10-0.35% by weight C;
0.10-4.00% by weight Mo;
optionally 1.50% by weight or less Si;
optionally 1.00% by weight or less Mn,
optionally 3.90% by weight or less Nb;
optionally 3.90% by weight or less V;
optionally 3.90% by weight or less W; and
optionally 3.90% by weight or less Ti;
the balance being Fe and 0.10% by weight or less of unavoidable impurities;
provided that the total of Mo, Nb, V, W and Ti is in the range of 0.1-4.0% by weight of the alloy,
wherein the alloy is configured to provide a coating, where the coating has a hardness of 56 HRC or greater as measured by SS-EN ISO 6508-1:2016.

2. The iron-based alloy according to claim 1, wherein the content of Cr is from 16.50-19.50% by weight.

3. The iron-based alloy according to claim 1, wherein the content of B is from 0.20-1.20% by weight.

4. The iron-based alloy according to claim 1, wherein the content of Ni is from 0.20-3.00% by weight.

5. The iron-based alloy according to claim 1, wherein the content of Nb is from 0.20-3.00% by weight.

6. The iron-based alloy according to claim 1, wherein the content of the optional components Nb, V, W and Ti is each 1.50% by weight or less.

7. The iron-based alloy according to claim 1, which is in powder form.

8. The iron-based alloy according to claim 7, wherein the powder contains no or less than 2% by weight of particles having a particle size exceeding 250 μm as measured by sieve analysis according to ASTM B214-16.

9. The iron-based alloy in powder form according to claim 7, which consists of particles having a particle size between 5-200 μm as measured by sieve analysis according to ASTM B214-16.

10. A method for forming an coated article, comprising the steps of
providing a substrate and
forming a coating on the substrate
wherein the step of forming the coating utilizes an alloy powder as defined in claim 7.

11. The method for forming a coated article according to claim 10, wherein the step of forming a coating is a laser cladding step, a plasma spraying step, a plasma transfer arc step High Velocity Air-Fuel coating spraying, cold spraying or a High Velocity Oxy-fuel coating spraying step.

12. The method for forming a coated article according to claim 10, wherein the article is a hydraulic cylinder or roller used in the mining or steel industry.

13. The iron-based alloy in powder form according to claim 7, which consists of particles having a particle size between 20-200 μm as measured by sieve analysis according to ASTM B214-16.

14. An article having a substrate and a coating, the coating being formed from an iron-based alloy as defined in claim 1.

15. Article according to claim 14, which is a hydraulic cylinder or roller used in the mining or steel industry.

16. The article according to claim 14, wherein the coating has one or both of
a hardness of 56 HRC or greater as measured by SS-EN ISO 6508-1:2016; and a corrosion resistance of 5000 hours (30 weeks) or more in a neutral salt spray test (5% NaCl) at 35° C. according to ISO 9227:2017.

17. The article according to claim 14, wherein the coating is metallurgically bond to the substrate.

18. The article according to claim 14, wherein the substrate is made of a metal or metal alloy.

19. The article according to claim 14, wherein the coating is formed by laser cladding, plasma spraying, High Velocity Oxy-fuel or High Velocity Air-Fuel coating spraying, cold spraying or plasma transfer arc of the iron-based alloy.

20. A method comprising forming a coating on a substrate with the iron-based alloy according to claim 1.

* * * * *